US006156263A

United States Patent [19]

An et al.

[11] Patent Number: 6,156,263

[45] Date of Patent: Dec. 5, 2000

[54] MOLTEN STEEL SMELTING APPARATUS FOR PRODUCING ULTRA-LOW CARBON STEEL

[75] Inventors: Sang Bok An, Pohang; Joon Yang Chung; Dae Saeng Kim, both of Kwangyang; Chang Hee Yim, Pohang; Byeong Og You, Kwangyang; Hyeon Soo Choi, Pohang; Wang Yeol Seo; Chang Hyun Lee, both of Kwangyang, all of Rep. of Korea

[73] Assignee: Pohang Iron & Steel Co., Ltd., Rep. of Korea

[21] Appl. No.: 09/077,906

[22] PCT Filed: Dec. 30, 1996

[86] PCT No.: PCT/KR96/00264

§ 371 Date: Jun. 4, 1998

§ 102(e) Date: Jun. 4, 1998

[87] PCT Pub. No.: WO98/15664

PCT Pub. Date: Apr. 16, 1998

[30] Foreign Application Priority Data

Oct. 8, 1996 [KR] Rep. of Korea ..... 96-44524

[51] Int. Cl.[7] ..... C21C 7/10

[52] U.S. Cl. ..... 266/209; 75/511; 266/210

[58] Field of Search ..... 266/209, 310; 75/511

[56] References Cited

FOREIGN PATENT DOCUMENTS

| | | | |
|---|---|---|---|
| 5288215 | 7/1977 | Japan . | |
| 5546445 | 11/1980 | Japan . | |
| 63-19216 | 1/1988 | Japan . | |
| 63-235862 | 9/1988 | Japan | 75/511 |
| 6400217 | 1/1989 | Japan . | |
| 6410061 | 1/1989 | Japan . | |
| 349966 | 7/1991 | Japan . | |
| 4289113 | 10/1991 | Japan . | |
| 4289114 | 10/1992 | Japan . | |
| 4308029 | 10/1992 | Japan . | |
| 4325620 | 11/1992 | Japan . | |
| 6-73431 | 3/1994 | Japan | 266/210 |
| 60-184619 | 9/1995 | Japan . | |

OTHER PUBLICATIONS

Japanese Patent Laid–Open No. 52088215 A, Abstract, Jul. 23, 1977, 1 p., English language.

Japanese Patent Laid–Open No. 80046445 B, Abstract, Nov. 25, 1980, 1, p., English language.

Japanese Patent Laid–Open No. 60184619 A, Abstract, Sep. 20, 1985, 1 p., English language.

Japanese Patent Laid–Open No. 63019216 A, Abstract, Jan. 27, 1988, 1 p., English language.

Japanese Patent Laid–Open No. 63195215 A, Abstract, Aug. 12, 1988, 1 p., English language.

Japanese Patent Laid–Open No. 64000217 A, Abstract, Jan. 5, 1989, 1 p., English language.

Japanese Patent Laid–Open No. Sho 64–10061, Abstract, Jan. 19, 1989, 1 p., English language.

Japanese Patent Laid–Open No. 4289113 A, Abstract, Oct. 14, 1992, 1 p., English language.

(List continued on next page.)

*Primary Examiner*—Melvyn Andrews

*Attorney, Agent, or Firm*—Webb Ziesenheim Logdson Orkin & Hanson, P.C.

[57] ABSTRACT

A molten steel refining apparatus and a method therefor, in which the carbon component of molten steel can be easily removed, the temperature drop of molten steel can be effectively reduced, and a stable operation is realized. The apparatus for refining molten steel for manufacturing ultra low carbon steel includes an RH vacuum-degassing device consisting of a vessel and a snorkel composed of an up-leg and a down-leg. The apparatus further includes a plurality of gas injection lance nozzles each consisting of an inner tube and an outer tube, and installed on the side wall of the vessel of the RH vacuum-degassing device so as to inject gas toward molten steel within the vessel. The inner tube includes a throat for forming a jet stream of super-sonic velocity, and the outer tube injects cooling gas for cooling the inner tube.

7 Claims, 11 Drawing Sheets

OTHER PUBLICATIONS

Japanese Patent Laid–Open No. 4289114 A, Abtsract, Oct. 14, 1992, 1 p., English language.

Japanese Patent Laid–Open No. 4308029 A, Abstract, Oct. 30, 1992, 1 p., English language.

Japanese Patent Laid–Open No. 4325620 A, Abstract, Nov. 16, 1992, 1 p., English language.

MOLTEN STEEL SMELTING APPARATUS FOR PRODUCING ULTRA-LOW CARBON STEEL

BACKGROUND OF THE INVENTION

1. Field of the Invention

The present invention relates to an apparatus for refining molten steel in a secondary refining process to manufacture ultra low carbon steel and a method for refining molten steel by utilizing the apparatus.

2. Description of the Prior Art

Generally, when an ultra low carbon steel with a carbon content of 70 ppm or less is manufactured, an RH vacuum degassing apparatus 100 (to be called "RH" below) of FIG. 1 is used. In the method using this apparatus, when molten steel which is tapped from a converter (not shown in the drawings) without killing during tapping arrives at the RH, firstly argon (Ar) gas is injected from a circulation gas supplying device 130, and at the same time, a snorkel 120 is dipped into a molten steel M which is contained within a ladle 140. At the same time, a vacuum pump 125 is activated to reduce the internal pressure of a vessel 110 to several Torr or several scores of Torr. Under this condition, molten steel M in the ladle 140 ascends into the interior of the vacuum vessel owing to the pressure difference between the vessel 110 and the atmosphere. At the same time, a decarburizing reaction occurs on the surface of molten steel M as shown in Equation (1) below. As the decarburizing reaction proceeds, the carbon content within molten steel M is decreased, and after elapsing of 15 to 25 minutes, the carbon content within molten steel M reaches 70 to 25 ppm.

$$[C]+[O]=CO(g) \quad (1)$$

That is, in the case where molten steel is refined by using the RH 100 of FIG. 1, a period of 15 minutes or more is required in reducing the carbon content to 70 ppm or less. Further, the temperature of molten steel is lowered by 1.5° C. per minute during the decarburization process, which is also a problem.

Meanwhile, Japanese Patent Application Laid-open Nos. Sho-52-88215 and Sho-52-89513 disclose molten steel refining apparatuses for manufacturing ultra low carbon steel. These apparatuses are constituted as follows. As shown in FIG. 2, a lance nozzle 150 is installed on the ceiling of the RH vessel 110, for injecting gaseous oxygen so as to shorten the decarburization period when producing ultra low carbon steel. Thus, during the decarburization of molten steel, gaseous oxygen is injected at high speed through the lance nozzle 150 onto the surface of molten steel within the vessel 110.

Further, Japanese Patent Application Laid-open Nos. Hei-4-289113, Hei-4-289114 and Hei-4-308029 disclose other apparatuses. These apparatuses are constituted as follows. As shown in FIG. 3, a height adjustable lance nozzle 160 is installed on the ceiling of the RH vessel 110, for injecting argon gas. During the decarburization of molten steel M for manufacturing ultra low carbon steel, argon gas is injected through the lance nozzle 160 onto the surface of molten steel M. When the carbon content of molten steel reaches 50 ppm, the lance nozzle 160 is dipped into molten steel M within the vessel 110 so as to inject argon gas into molten steel M, thereby manufacturing ultra low carbon steel.

In the apparatuses of FIGS. 2 and 3, the lance nozzles 150 and 160 are made of copper. In the case where these apparatuses are used for carrying out the decarburization, argon and oxygen are injected onto the surface of molten steel M, so that the decarburization speed for ultra low carbon steel is promoted, and to minimize the temperature decrease within the vessel 110.

However, in the case where the apparatuses of FIGS. 2 and 3 are used for carrying out the decarburization, the internal temperature of the vacuum vessel 110 is raised to 800 to 1200° C., with the result that the copper lance is liable to be damaged or partially melted. If the cooling water leaks, the cooling water intensely reacts with molten steel at 1600° C., creating the possibility that the vacuum vessel may explode.

Japanese Patent Application Laid-open No. Sho-64-217 discloses another apparatus. In this apparatus, two straight tubes are installed on the side wall of the RH vessel, and carbon monoxide is injected through the straight tubes (single layer tubes) during refining, while oxygen is injected through a lance which is installed on the ceiling of the RH. Thus, the combustion of carbon monoxide decreases the temperature drop of the molten steel during refining.

In the case where carbon monoxide is injected through the straight tubes as in the above method, the combustion of carbon monoxide produces a flame jet, the shape of which is shown in FIG. 14A. In this method, carbon monoxide reacts with oxygen which is injected from the ceiling, thereby preventing an excessive temperature drop in the molten steel. However, the promotion of decarburization reaction is difficult, and the cooling capability of the straight tubes of single layer is deteriorated. Therefore, when the use period is extended, the straight tubes are apt to be melted by radiation heat of molten steel, and the surrounding refractory is melt-damaged.

Japanese Patent Application Laid-open No. Sho-63-19216 discloses another apparatus. In this apparatus, a plurality of single layer straight tubes are installed with different heights on the side wall of the RH vessel. Thus, during the decarburization of molten steel, oxygen is injected onto the surface of molten steel within the RH vessel.

Since the nozzle for injecting oxygen is attached to the straight tube, the oxygen stream does not form a jet stream, but forms the oval shape of FIG. 14A. Injected oxygen gas is used to supply oxygen into molten steel.

In this method, however, since the injected oxygen gas does not form ajet stream, a cavity on molten steel surface cannot be formed. Therefore, the area in which the decarburization occurs cannot be expanded and the problem that the decarburization cannot be promoted occurred.

Further, in this method, since a plurality of the straight tubes are installed on the side wall of the RH vessel, the evacuating capability for vacuum is greatly deteriorated, and therefore, its practicality is questionable. Further, as the use period elapses, the single layer straight tubes undergo lowering of the cooling capability, and therefore, melting loss occurs. Further, melting loss occurs in the surrounding refractory materials, and therefore, the life expectancy of the RH vacuum vessel is significantly shortened. Therefore, the apparatus is economically disadvantageous.

SUMMARY OF THE INVENTION

In order to solve the problems of the conventional techniques described above, the present inventors carried out research and studies, and the present inventors came to propose the present invention based on the results of the research and studies.

The present invention provides molten steel refining apparatus and a method therefor, in which the carbon in molten steel can be easily removed, the temperature drop of molten steel can be effectively reduced, and a stable operation is realized.

In achieving these desired results, the apparatus for refining molten steel for manufacturing ultra low carbon steel according to the present invention includes: an RH vacuum-degassing device consisting of a vessel, and a snorkel comprising an up-leg and a down-leg, and the apparatus further includes: a plurality of gas injecting lance nozzles each consisting of an inner tube and an outer tube, which are installed on a side wall of the vacuum vessel of the RH vacuum-degassing device so as to inject gas toward molten steel within the vessel; the inner tube including a throat for making ajet stream of super-sonic velocity; and the outer tube injecting cooling gas for cooling the inner tube.

In another aspect of the present invention, the method for refining molten steel for manufacturing ultra low carbon steel by using an RH vacuum-degassing facility including a vessel and snorkel consisting of an up-leg and a down-leg according to the present invention, includes the steps of:

installing on the side wall of the vessel of the RH vacuum-degassing facility a plurality of gas injecting lance nozzles each consisting of an inner tube having a straight portion and a throat for forming a jet stream of super-sonic velocity, and an outer tube for injecting cooling gas for cooling the inner tube;

raising a teeming ladle containing the molten steel, supplying circulating gas into the up-leg, and lowering internal pressure of the vessel so as to cause molten steel in the teeming ladle to rise through the up-leg into the vessel; and injecting oxygen containing gas or oxygen in the form of a jet stream toward molten steel through each of the inner tubes upon recognizing an internal pressure of 150 mbar in the vessel, and injecting cooling gas through each of the outer tubes for cooling the inner tubes.

BRIEF DESCRIPTION OF THE DRAWINGS

The above-described aspects and other advantages of the present invention will become more apparent by describing in detail a preferred embodiment of the present invention with reference to the attached drawings in which.

DETAILED DESCRIPTION OF THE PREFERRED EMBODIMENT

Figure 1:
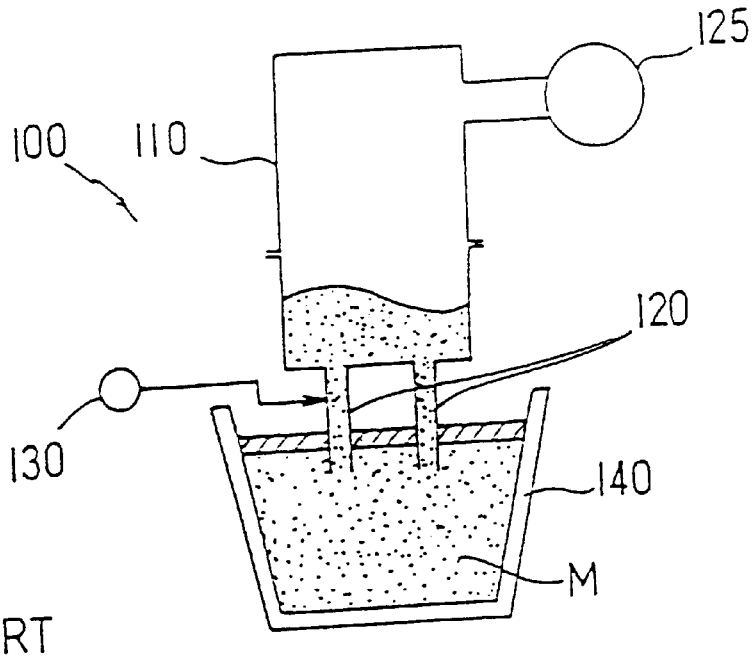
PRIOR ART FIG.1
FIG. 1 illustrates a conventional molten steel refining apparatus for manufacturing ultra low carbon steel.
Figure 2:
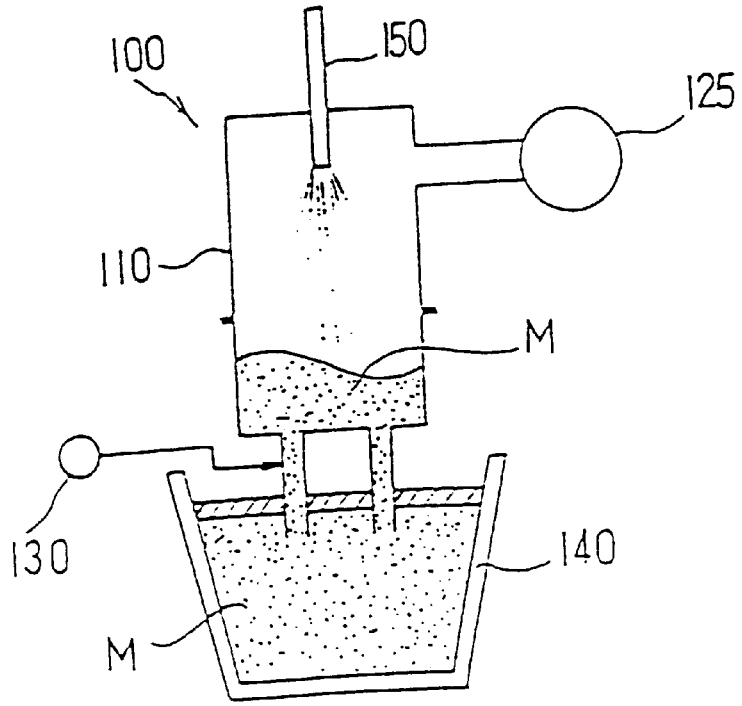
PRIOR ART FIG.2
FIG. 2 illustrates another conventional molten steel refining apparatus for manufacturing ultra low carbon steel.
Figure 3:
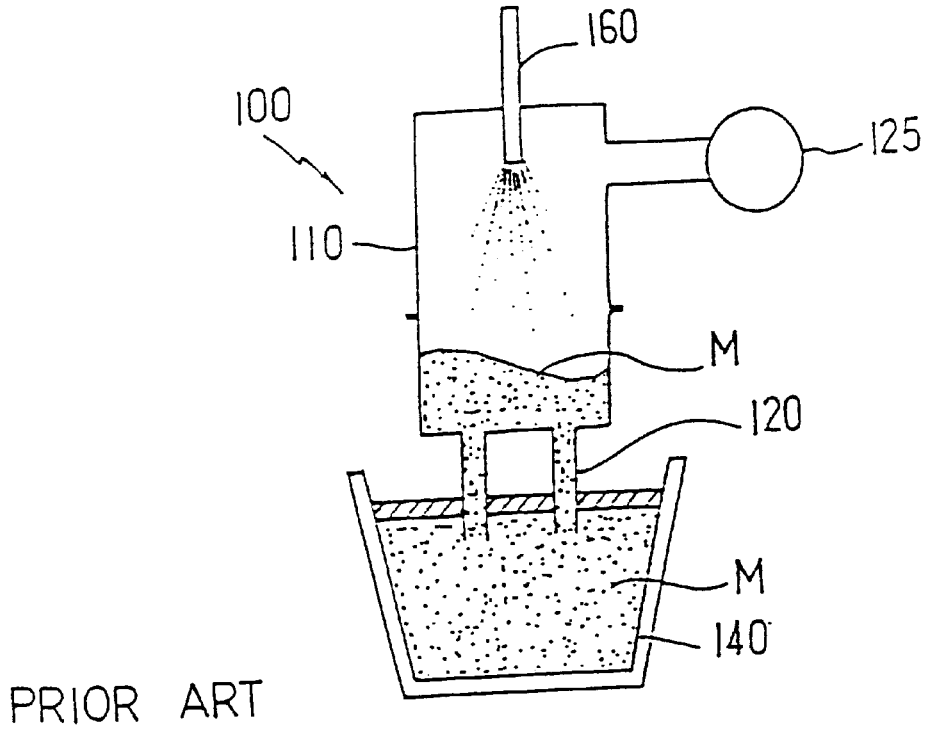
PRIOR ART FIG.3
FIG. 3 illustrates still another conventional molten steel refining apparatus for manufacturing ultra low carbon steel.
Figure 4:
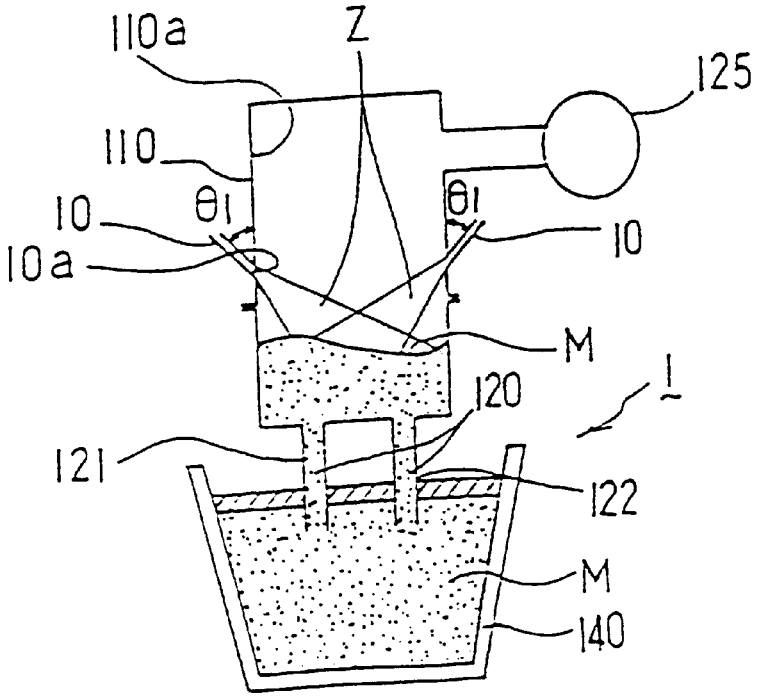
FIG. 4 illustrates a presently preferred molten steel refining apparatus according to the present invention.
Figure 7:
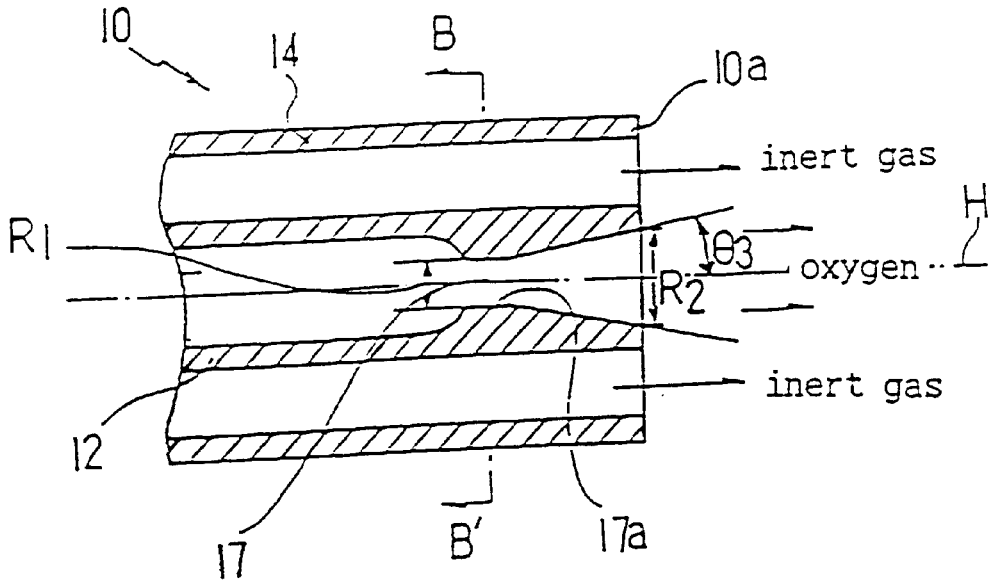
FIG. 7 is a sectional view taken in the lengthwise direction of the nozzle provided in the molten steel refining apparatus of the present invention.

As shown in FIGS. 4 and 7, the molten steel refining apparatus according to the present invention includes a plurality of gas injection lance nozzles 10 which is installed on the side wall of a vessel 110 of the conventional RH vacuum-degassing device. Each of the lance nozzles 10 consists of an inner tube 12 and an outer tube 14. The inner tube 12 injects oxygen or oxygen containing gas in the form of ajet stream, and the outer tube 14 injects cooling gas for cooling the inner tube 12.

As shown in FIG. 7, the inner tube 12 of the lance nozzle 10 includes a throat 17 which forms ajet stream of super-sonic velocity during the injection of oxygen or oxygen containing gas.

A leading end portion 10*a* of the lance nozzle 10 should be preferably disposed evenly with an inner wall 10*a* of the vessel 110, see FIG. 4.

Preferably, two or four of the lance nozzles 10 are installed on the side wall of the vacuum vessel. The reasons are as follows. That is, if only one lance nozzle 10 is installed, the size of the lance nozzle 10 should be large so as to sufficiently inject oxygen, and therefore, difficulty is encountered in carrying out the required maintenance. If three lance nozzles 10 are installed, it is difficult to install the nozzles 10 symmetrically on the side wall of the vessel 110. Therefore, the flow of the molten steel may be impeded, and it is difficult to set the fire spot on the surface of the molten steel.

Further, in the case where five or more lance nozzles 10 are installed, still more difficulties are encountered. That is, the time period of supplying oxygen gas is much shorter than that of carrying out the decarburization. During the period when the oxygen gas is not injected, inert gas such as argon or nitrogen should be supplied through the outer tube 14, so that the inner tube 12 can be protected from thermal melting loss, and the adherence of skull thereto can be prevented. Nitrogen can be used when manufacturing ultra low carbon steel with no limitation in the nitrogen content. Thus, in the case where the lance nozzles 10 number 5 or more, the outer tube 14 has to inject cooling gas in an increased amount. Therefore, not only is the vacuum level lowered, but also the maintenance of the lance nozzle 10 becomes difficult. Therefore, it is preferred to install two or four lance nozzles 10.

Further, the lance nozzles 10 should be preferably installed above the level of molten steel which coincides with surface M on the side wall of the vessel at a height 1.9 to 3.0 times the vessel radius. If the height is less than 1.9 times the vessel radius, the angle θ1 between the lance nozzle 10 and the inner wall 110*a* of the vessel becomes too small in relative terms. Therefore, during the installation of the lance nozzles 10, it becomes difficult to cut the refractory material around the side wall of the vessel. Further, the oxygen jet stream collides with the refractory material located in the lower part of the lance nozzle 10, and therefore, the life expectancy of the refractory material is shortened.

If the height of the nozzle 10 exceeds 3.0 times the vessel radius, the reaction efficiency of the oxygen jet stream becomes low due to the high level of the lance nozzle 10. Further, depending on the cases, the oxygen jet stream collides with the opposite side wall and results in shortening of the life expectancy of the collided portion.

Therefore, by way of example, if the radius of the vessel is 1040 mm, the optimum height of the lance nozzle from the top of the molten steel should be between 1976 mm to 3120 mm.

The angle θ1 between the lance nozzle 10 and the side wall of the vessel should be preferably 20° to 35°. If the angle θ1 is less than 20°, the oxygen jet stream Z collides with the refractory located below the lance nozzle and results in shortening of the refractory life. On the other hand, if the angle θ1 is more than 35 °, the oxygen jet stream Z departs from the fire spot of the surface of the molten steel and hits the refractory material of the opposite side wall of the vessel. Consequently, the refractory life is greatly shortened, and therefore, the injection of oxygen gas becomes practically impossible in this case.

Figure 5:
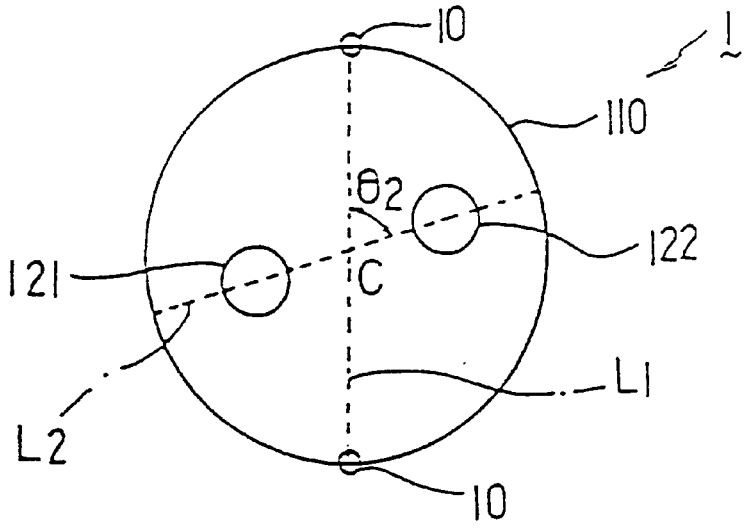
FIG. 5 illustrates a case of two nozzles provided in the apparatus of the present invention.

In the case where two lance nozzles 10 are provided as shown in FIG. 5, the positions of the lance nozzles 10 on the side wall in a plan view should be as follows. A line L1 connecting the two lance nozzles 10 and passing through the diametric center C of the vessel should form an angle θ2 of 60° to 120° relative to a line L2 diametrically connecting an up-leg 121 and a down-leg 122 of a snorkel 120. If the angle θ2 is less than 60° or more than 120°, the igniting point on the surface of the molten steel is biased to an up-leg or a down-leg. Consequently, the flow of the molten steel M which is introduced from the ladle 140 into the vessel 110 is impeded, and therefore, the angle θ2 should be preferably 60° to 120°.

Figure 6:
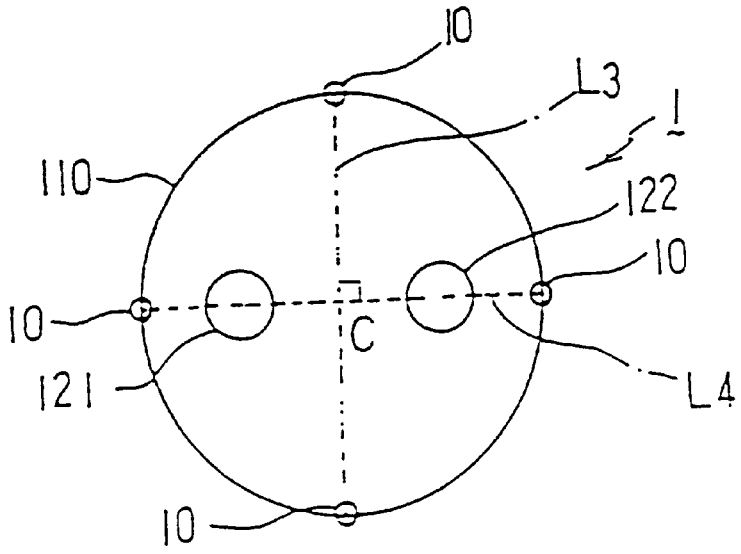
FIG. 6 illustrates a case of four nozzles provided in the apparatus of the present invention.

In the case where four lance nozzles 10 are installed as shown in FIG. 6, the lance nozzles 10 have to be disposed in the following manner. Diametric lines L3 and L4 which connect the two opposite pairs of the lance nozzles 10 pass through the center C of the vessel 110, and the two diametric lines L3 and L4 intersect at right angles with each other. Thus, in the case where four lance nozzles 10 are installed, it is most effective to make the straight lines L3 and L4 pass through the center of the vacuum vessel, and to make the two straight lines L3 and L4 intersect with each other at right angles.

Figure 8:
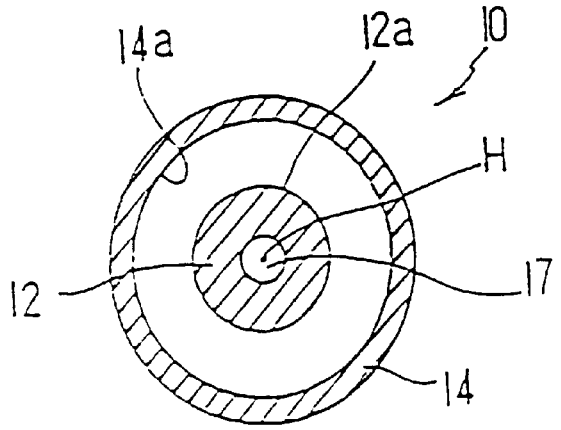
FIG. 8 is a sectional view taken along line B—B of FIG. 7.

As shown in FIGS. 7 and 8, each of the oxygen injection lance nozzles 10 consists of an inner tube 12 and an outer tube 14. The inner and outer tubes 12 and 14 are coaxially aligned around a center line H. It is preferable to provide a gap of 2 to 4 mm between an outer circumference of the inner tube 12 and an inner circumference of the outer tube 14. If the mentioned gap is less than 2 mm, the cross sectional area of the space between the inner and outer tubes 12 and 14 is too small, and therefore, cooling gas cannot be supplied in sufficient amount. Further, in manufacturing the lance nozzle 10, it is difficult to make the inner and outer tubes 12 and 14 coaxially disposed around the center line H, and to make the inner and outer tubes 12 and 14 have the same thickness.

On the other hand, if the mentioned gap is more than 4 mm, the cross sectional area of the mentioned space becomes too large, and therefore, cooling gas injection rate becomes too high, with the result that the vacuum level is lowered. Therefore, it is preferable to provide a gap of 2 to 4 mm.

In addition, the inner and outer tubes 12 and 14 should be preferably made of stainless steel, refractory, ceramic, or alloy metal which can retain the proper strength at a temperature of 1200° C. or above.

Further, the thickness of the inner and outer tubes 12 and 14 should be preferably 3–6 mm. If the thickness is less than 3 mm, the tube cannot withstand the pressure of the oxygen gas or the argon gas. If the thickness is more than 6 mm, there is the disadvantage that the cost of the lance nozzle 10 is increased.

As shown in FIG. 7, the inner circumferential surface of the inner tube 12 of the lance nozzle 10 is narrowed coming toward a throat 17. A cylindrical portion 17*a* is formed at the throat 17. The throat expands at a constant angle θ3, reaching a maximum inside diameter R2 formed at the leading end 10*a* of the lance nozzle 10.

Under this condition, the cylindrical portion (straight or constant diameter portion) 17*a* of the throat 17 should preferably have a length of 4 to 6 mm. If the length of portion 17*a* is less than 4 mm, it cannot withstand the gas pressure. If the length is more than 6 mm, friction is increased under applied gas pressure, resulting in decreased gas pressure, thereby causing a disadvantage in injecting gas.

The angle θ3 of the leading end portion should be preferably 3° to 10°, because with an angle of less than 3°, a super-sonic velocity cannot be obtained, while if the angle exceeds 10°, strays from the jet stream occur, and the flow velocity is slowed.

In addition, the ratio of the inside diameter R1 of the throat 17 to the inside diameter R2 of the leading end portion 10*a* of the nozzle 10 should be preferably 1.1 to 3.0. If the ratio (R2/R1) is less than 1.1, a super-sonic velocity cannot be obtained. If the ratio exceeds 3.0, the supply pressure of oxygen gas has to be very high, and the required level of pressure cannot be industrially obtained.

If the angle θ3 of the leading end is 4°, and the ratio (R2/R1) is 1.7, then oxygen gas velocity reaches to Mach 2.0 (630 m/sec).

Figure 9:
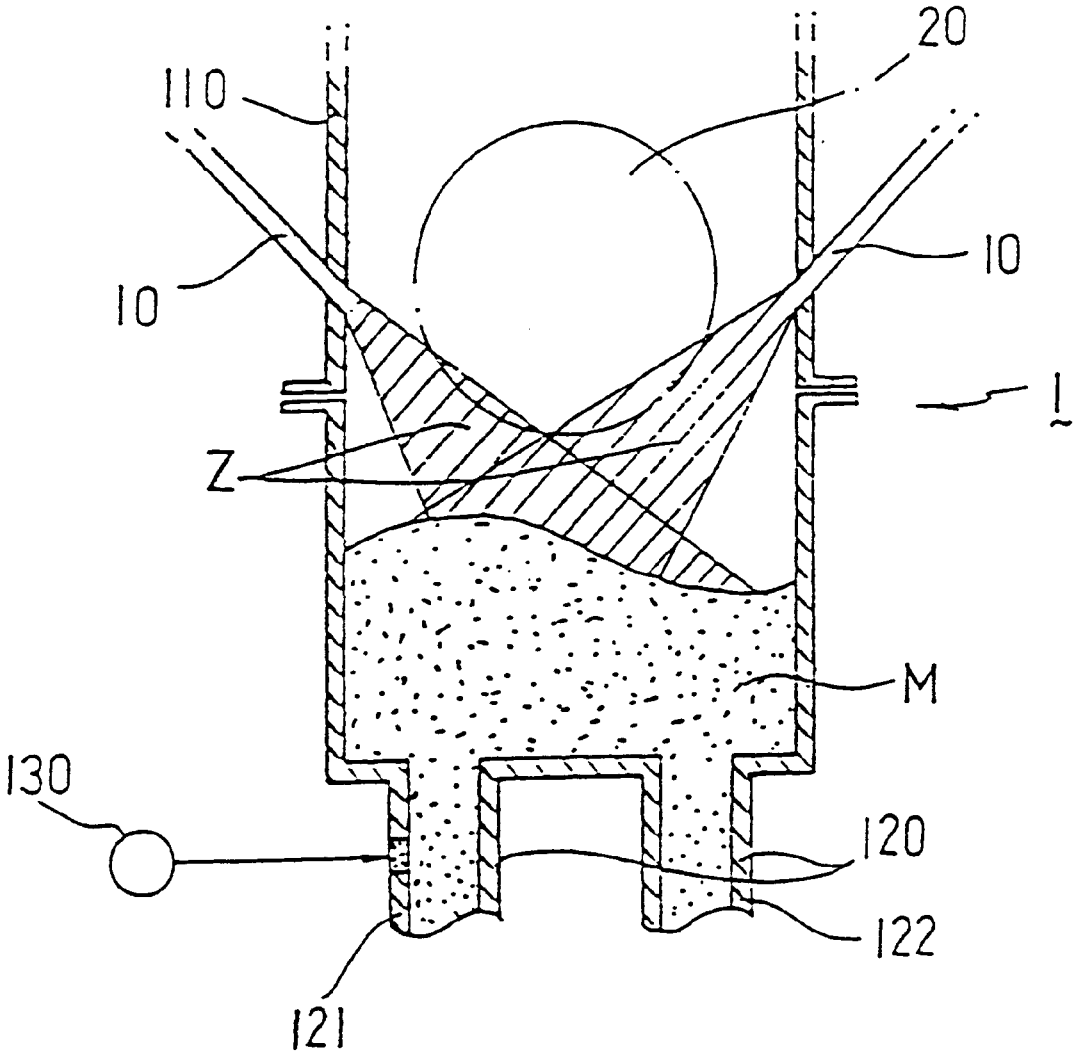
FIG. 9 illustrates a state in which jet streams are injected from the nozzles of the molten steel refining apparatus according to the present invention.

Now the method for refining molten steel by using the refining apparatus of the present invention will be described with reference to FIGS. 4 and 9.

Molten steel which has undergone a converter refining process is tapped to the teeming ladle 140, and the ladle 140 is carried to the refining apparatus 1 of the present invention.

Then a circulating gas is supplied into an up-leg 121 by means of a circulation gas supplying device 130, while the teeming ladle 140 is raised. At the same time, a vacuum pump 125 is activated to lower the internal pressure of the vessel 110, so that molten steel M of the teeming ladle 140 would ascend through an up-leg 121 into the vessel 110.

Under this condition, the raised height of the molten steel within the vessel 110 becomes different depending on the pressure difference between the ambient air and the interior of vessel 110. For example, if internal pressure of the vessel is 150 mbar, the raised height of the molten steel becomes 200 mm.

After the initiation of the refining, when the internal pressure of the vacuum vessel 110 reaches 150 mbar, oxygen gas or oxygen containing gas is injected through the inner tube 12 of the lance nozzle 10 of the refining apparatus 1 toward the surface of the molten steel, in such a manner that a jet stream should be formed. At the same time, cooling gas is injected through the outer tube 14 to cool the inner tube 12.

The gas injection through the inner tube 12 is carried out for at least 3 minutes from the start of injection or for maximum up to the end of decarburization. Gas injection through the outer tube 14 is carried out until the refining is completed.

Figure 15:
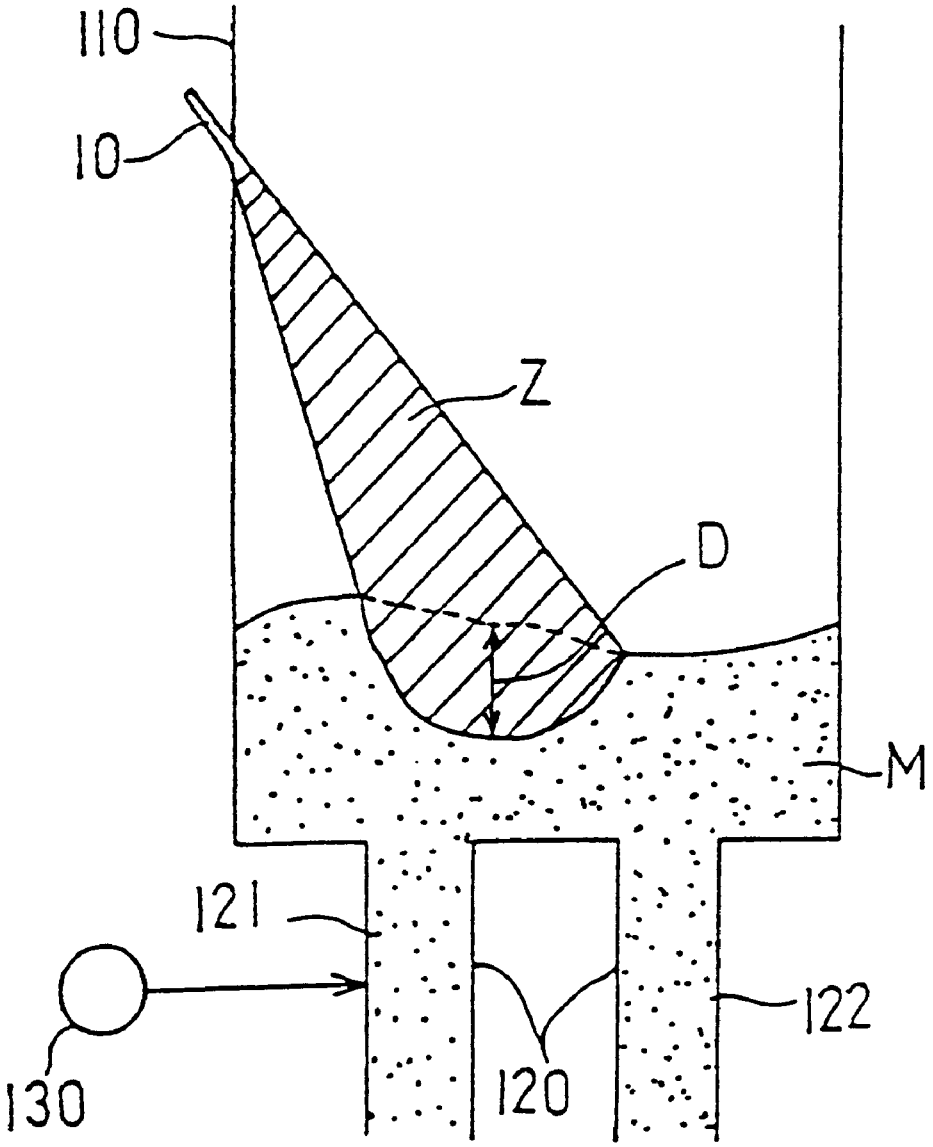
FIG. 15 illustrates the contour of the surface of molten steel during injection of oxygen in the present invention.

If oxygen gas is injected with a super-sonic velocity before the vacuum level of the vacuum vessel 110 attains 150 mbar, then a large cavity D is formed on the surface of the molten steel M as shown in FIG. 15. Therefore, it is appreciated that damage may occur on the bottom part of refractory material in the vessel when this condition exists. Therefore, it is preferable that the injection of oxygen gas or oxygen containing gas should start after 150 mbar is reached.

Oxygen containing gas which is injected through the inner tube 12 of the lance nozzle 10 should be preferably a mixture of oxygen and carbon monoxide.

When refining molten steel, a mixture of oxygen and carbon monoxide is injected through the inner tubes 12 of the plurality of the lance nozzles 10 for at least 3 minutes to at most the completion of the decarburization, with a predetermined flow rate. Thus, a reaction as shown in Equation 3 (to be discussed later) is induced, so that the temperature drop of the molten steel can be effectively reduced.

Under this condition, if the lance nozzle 10 is made of stainless steel or other heat resistant alloy, the proportion of carbon monoxide within gas mixture should preferably not exceed 30%. If it exceeds 30%, the decarburization reaction of Equation 2 (to be discussed later) is impeded, and the reaction of Equation 3 cannot be realized. Further, the amount of carbon monoxide sucked into the vacuum pump 125 is increased, with the result that environmental pollution is aggravated, and the life expectancy of the lance nozzle 10 is shortened.

Further, cooling gas which is injected through the outer tube 14 of the lance nozzle 10 may consist of argon gas, carbon dioxide, other inert gases, carbon monoxide-containing mixture gas or carbon dioxide containing mixture gas. Nitrogen as an inert gas may be used for manufacturing an ultra low carbon steel in which the nitrogen content is not regulated.

In the case where a mixture of argon and carbon monoxide is used as the cooling gas of the outer tube 14, carbon monoxide reacts with the oxygen gas as shown in Equation 3 within the vessel, with the result that a large amount of heat is generated compared with the case where only argon is used. Meanwhile, in the case where the lance nozzle 10 is made of stainless steel or other heat resistant alloy, the volume proportion of carbon monoxide within mixture gas should preferably not exceed 30%. If it exceeds 30%, the reaction of Equation 3 cannot be realized. Further, an increased amount of carbon monoxide is sucked into the vacuum pump 125, resulting in environmental pollution and a shortened life expectancy of the lance nozzle 10.

In the case where carbon dioxide is injected through the outer tube 14, the inner tube 12 is easily cooled while saving argon, and therefore, the manufacturing cost for molten steel can be reduced.

Meanwhile, in the case where molten steel M is refined for manufacturing ultra low carbon steel, oxygen sources such as iron ore or mill scale may be injected at high speed through the inner tube 12 of the lance nozzle 10 together with the carrier gas such as argon or oxygen toward the surface of molten steel M. In this manner, the decarburization period can be easily shortened, and the carbon component can be easily reduced.

The reason is as follows. Iron ore or mill scale which is injected at high speed penetrates into molten steel and decomposes into iron and soluble oxygen, thereby supplying oxygen to molten steel and providing sites for decarburization reactions. Here, the lance nozzle should be preferably made of ceramic or refractory material, and gas which is injected through the outer tube 14 should preferably consist of carbon monoxide.

In the case where the lance nozzle is made of stainless steel or heat resistant alloy, the inner tube 12 is easily worn out by iron ore or mill scale so as to shorten the life of the lance nozzle 10. The reason why carbon monoxide is injected through the outer tube 14 is for compensating the temperature based on the reaction of Equation 3.

The injection pressure of oxygen or oxygen containing gas which is injected through the inner tube 12 of the lance nozzle 10 should be preferably 8.5 to 13.5 $Kg/cm^2$.

If the injection pressure is less than 8.5$Kg/cm^2$, the inside diameter of the inner tube 12 of the lance nozzle 10 has to be large for ensuring the required amount of oxygen. Further, the cooling gas such as an inert gas should be supplied in increased amounts through the outer tube 14 during refining, and therefore, the vacuum level may be aggravated.

In the case where the injection pressure is more than 13.5 $Kg/cm^2$, there is an advantage that the diameter of the inner tube 12 can be reduced, but the depth of the cavity or depressions D which are formed on the surface of molten steel is decreased, thereby shortening the life expectancy of the bottom refractory of the vessel 110.

The injection rate of oxygen or oxygen containing gas should be preferably 20 to 50 $Nm^3$/min, the injection time period is increased, and therefore, the refining time is increased.

On the other hand, if the injection rate is more than 50 $Nm^3$/min, the injection time period is shortened, but the oxygen reaction efficiency is decreased, because a large amount of oxygen is injected within a short period of time. Further, the diameter of the inner tube 12 should be made large, and the cooling gas should be supplied in an increased amount through the outer tube 14, again aggravating the vacuum level.

The amount of the oxygen gas which is injected onto the molten steel M is adjusted in accordance with the carbon content of the molten steel in the following manner. For each 0.1 weight % of carbon within the molten steel, the oxygen gas should be injected preferably in an amount of 0.9 to 1.2 $Nm^3$ per ton of molten steel ($Nm^3$/T-S).

If oxygen is less than 0.9 $Nm^3$/T-S, then the decarburization reaction and the post combustion reaction become low in relative terms. If it exceeds 1.2 $Nm^3$/T-S, the decarburization reaction and the post combustion reaction can be obtained as much as required, but the oxygen concentration within molten steel becomes excessively high. Therefore, an excessive amount of deoxidizing agent has to be used, and the product quality is deteriorated.

Cooling gas which is injected through the outer tube 14 should have pressure of 3.0 to 5.0 $Kg/cm^2$ preferably, while its injection rate should be preferably 3.0 to 5.0 $Nm^3$/min.

If the pressure is less than 3.0 Kg/cm$^2$, the diameter of the outer tube 14 has to be increased to obtain the required amount of injection gas, and therefore, increasing the manufacturing cost of the lance nozzle. If the pressure is more than 5.0 Kg/cm$^2$, the diameter of the outer tube is decreased, and therefore, it is economically advantageous. However, gas which has been injected from the outer tube 14 collides with the oxygen jet Z of the inner tube 12 immediately after departure from the outer tube, and therefore, the oxygen reaction efficiency is decreased.

Meanwhile, if the gas of the outer tube 14 has an injection rate of less than 3.0 Nm$^3$/min, the required cooling efficiency cannot be obtained. Therefore, the temperature of the inner tube 12 rises, and a melting loss occurs in the inner tube 12, thereby shortening the life expectancy of the inner tube 12. On the other hand, if the injection rate is more than 5.0 Nm$^3$/min, the gas supply is increased, and the vacuum level may be aggravated. Therefore, it is preferable to limit the injection rate to 3.0 to 5.0 Nm$^3$/min.

The gas which is injected through the outer tube 14 performs the role of preventing the inner tube 12 from being melted by a radiation heat, and therefore, the gas should have a temperature of preferably 30° C. or below. At a temperature above this level, required cooling capability cannot be obtained.

In the present invention, four lance nozzles may be provided. During the decarburization of molten steel, oxygen gas or oxygen containing gas is injected at a rate of 5–10 Nm$^3$/min through the inner tubes of the lance nozzles 10 which are installed at the left and right sides of the immersion tube 120 (FIG. 6). Through the balance of the lance nozzles 10, oxygen gas or oxygen containing gas is injected at a rate of 20–50 Nm$^3$/min. Thus, the concentration of carbon monoxide within the exhaust gas of the refining apparatus is controlled to preferably 1% or less.

In another preferred embodiment of the present invention, two lance nozzles may be provided. At the start of the decarburization of molten steel, oxygen gas or oxygen containing gas is injected at a rate of 5–10 Nm$^3$/min through the inner tubes of the lance nozzles 10, while the outer tube 14 is made to inject cooling gas at a rate of 3–5 Nm$^3$/min. Then at an intermediate point during the decarburization, the inner tubes are made to inject oxygen gas in an increased rate of 20–50 Nm$^3$/min, while maintaining the injection of cooling gas by the outer tube at a rate of 3–5 Nm$^3$/min.

Further, in the present invention, after the termination of the oxygen gas injection through the inner tube 12, cooling gas is injected through the inner tube until the completion of the refining, so that skull can be prevented from being adhered.

If molten steel is refined based on the method of the present invention by using the refining apparatus of the present invention, the following phenomenon occurs. The oxygen gas which is injected by the inner tube 12 toward the surface of molten steel forms ajet stream Z as shown in FIG. 9. Further, on the surface of molten steel M, there occurs decarburization reaction as shown in Equation 2 below. The oxygen gas which forms a jet stream Z as shown in FIG. 15 strongly pushes molten steel, so as to form cavity D. Consequently, the surface area in which the decarburization reaction occurs is increased, and the reaction of Equation 2 occurs on the surface. Therefore, the carbon component within molten steel can be easily decreased and the decarburization time period can be effectively shortened. In Equation 2, oxygen gas is then spouted through the lance nozzle 10 of the refining apparatus. The "[C]" is the carbon which is dissolved within molten steel.

$$\tfrac{1}{2}O_2(g)+[C]=CO(g) \quad (2)$$

$$CO(g)+\tfrac{1}{2}O_2(g)=CO_2(g)+Q \quad (3)$$

Meanwhile, in a heat preserving zone 20, a reaction occurs between carbon monoxide and oxygen gas. Carbon monoxide which participates in the reaction of Equation 3 is produced by the reaction of Equation 2 so as to ascend toward the vacuum pump 125. Oxygen gas of Equation 3 is that which has been injected through the lance nozzle 10, and as a result of the Equation 3, a large amount of heat is generated. Consequently, the internal temperature of the vessel rises, and therefore, the amount of skull adhered onto the inner wall of the vessel is decreased while the temperature drop is decreased during the decarburization of molten steel M.

Now the present invention will be described based on actual examples.

EXAMPLE 1

Four lance nozzles 10 were installed in an RH vacuum-degassing apparatus having a capacity of 250 tons. The height of lance nozzles 10 was 2800 mm above the surface of molten steel M, i.e., 2.7 times the inside vessel diameter (1040 mm). The angle θ1 between the lance nozzle 10 and the side wall of the vessel was 20°, and all of the four lance nozzles 10 had the same angle. The lance nozzle 10 was made of stainless steel, while the inside diameter R1 of the throat 17 and the exit diameter R2 of the leading end portion 10*a* were 9.9 mm and 12.4 mm respectively. The angle θ3 of the divergent section was 6°, the gap between the inner tube 12 and the outer tube 14 was 3 mm, and the length of the cylindrical portion 17*a* of the throat 17 was 4 mm.

The carbon content within molten steel M was 450 ppm, and the target carbon content of the extra low carbon steel was 50 ppm. During the decarburization of molten steel for this ultra low carbon steel, the inner tubes 12 of the nozzles 10 were made to inject oxygen gas with pressure of 9.5 Kg/cm$^2$ and at an injection rate of 30 Nm$^3$/min. The outer tubes 14 were made to inject argon with pressure of 4.0 Kg/cm$^2$ and at an injection rate of 4 Nm$^3$/min. For one charge, oxygen gas was injected in an amount of 0.60 Nm$^3$ per ton of the molten steel for 6 minutes starting from a vacuum level of 150 mbar. Under this condition, the total decarburization time period was limited to 16 minutes, and after the decarburization of 16 minutes, deoxidation was carried out for 1 minute.

Figure 10:
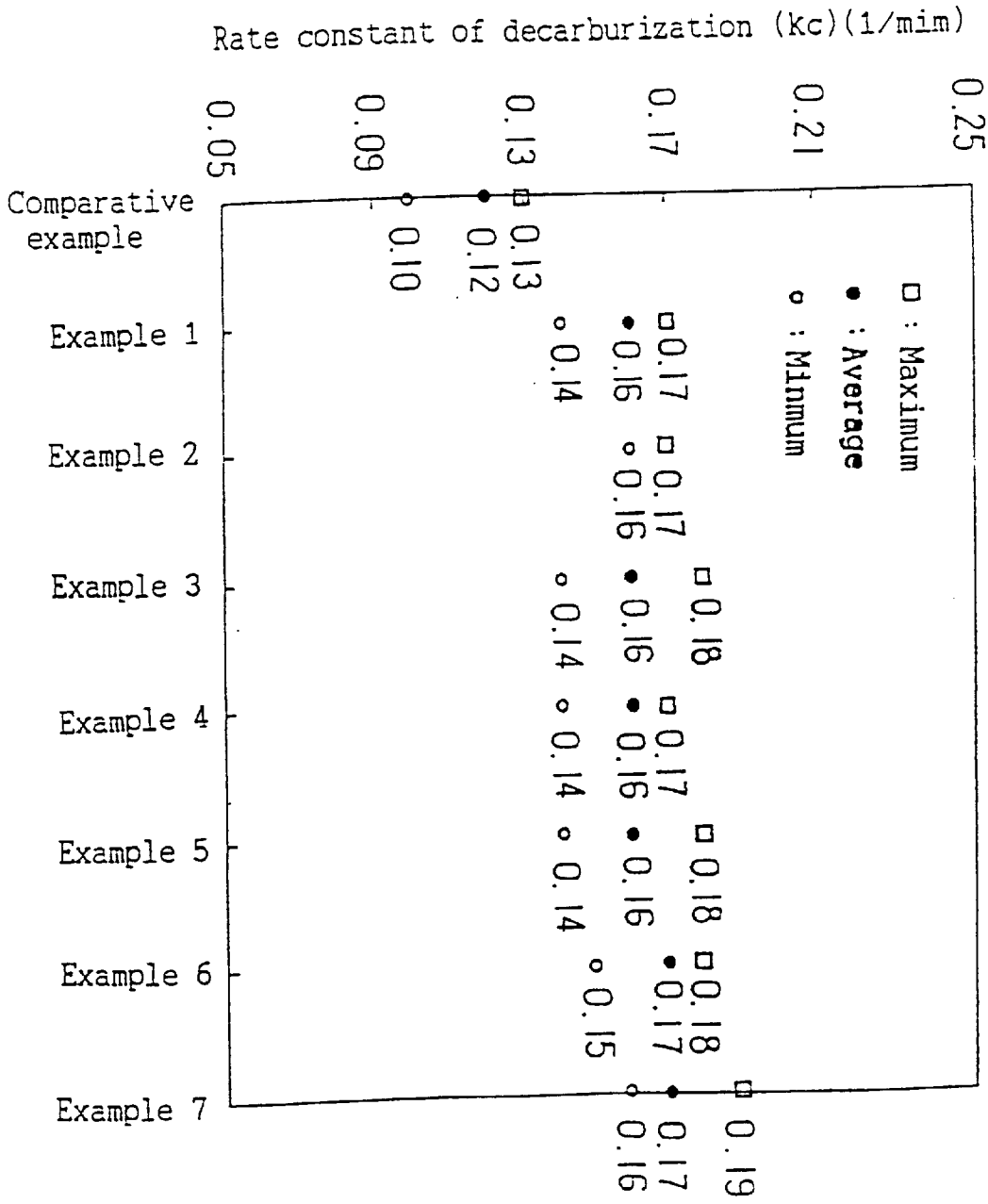
FIG. 10 is a graphical illustration showing the decarburization reaction rate for the method of the present invention and a comparative example.

Then test samples were taken at the time (0 minute) of starting the decarburization and immediately after the decarburization (17 minutes). These samples were put into a carbon/sulphur analyzer to analyze the carbon contents. By utilizing the analyzed values, rate constants of decarburization Kc were calculated based on Equation 4 below. These constants, together with that of a comparative example, are illustrated in FIG. 10. In Equation 4, C(17) and C(0) represent the carbon contents at 17 minutes and 0 minute respectively.

Figure 11:
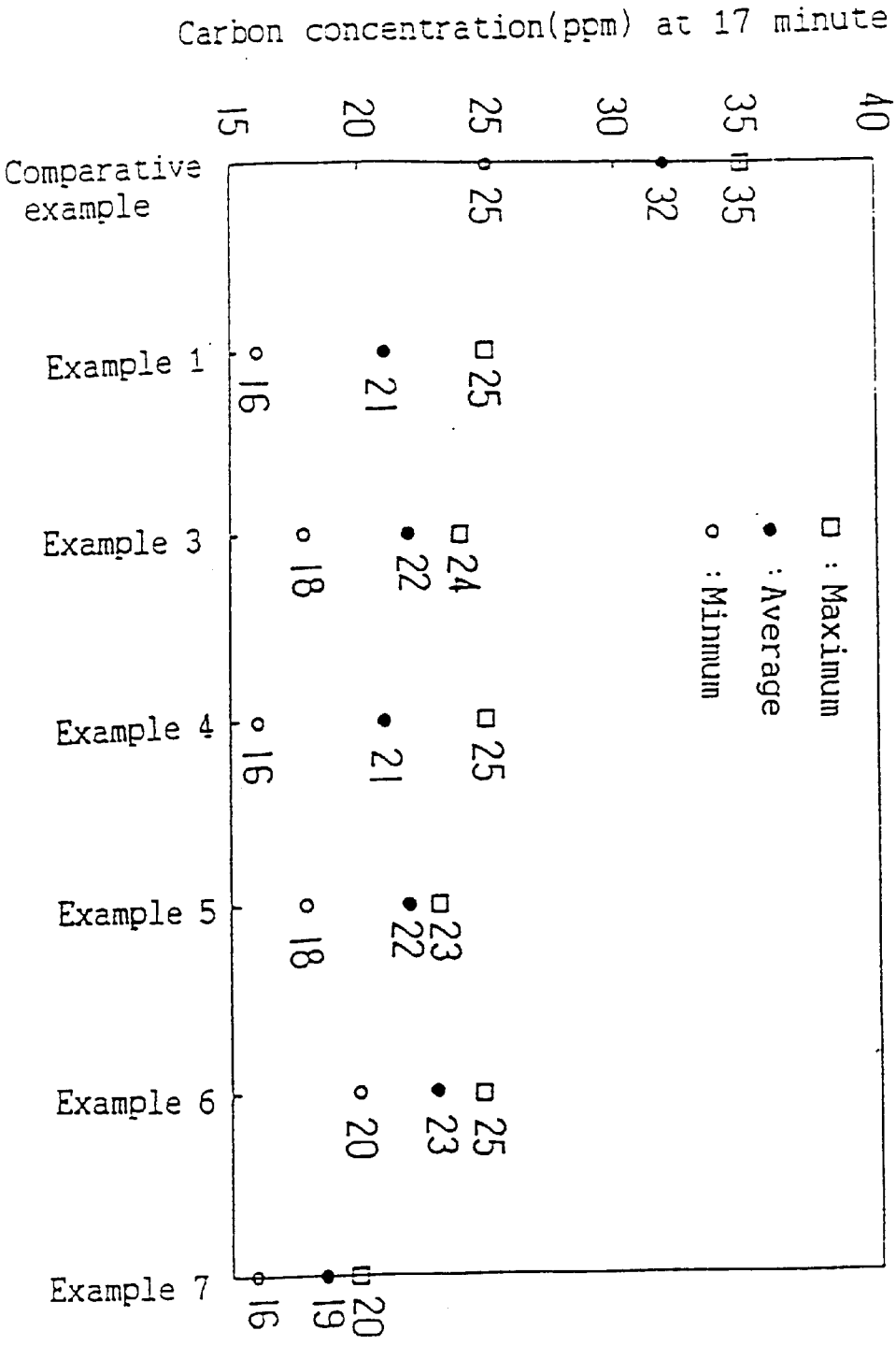
FIG. 11 is a graphical illustration showing the carbon content within the molten steels for the method of the present invention and a comparative example.

Further, when 17 minutes had elapsed from the start of the decarburization, the carbon contents of molten steel were measured, and the results are illustrated in FIG. 11.

Figure 12:
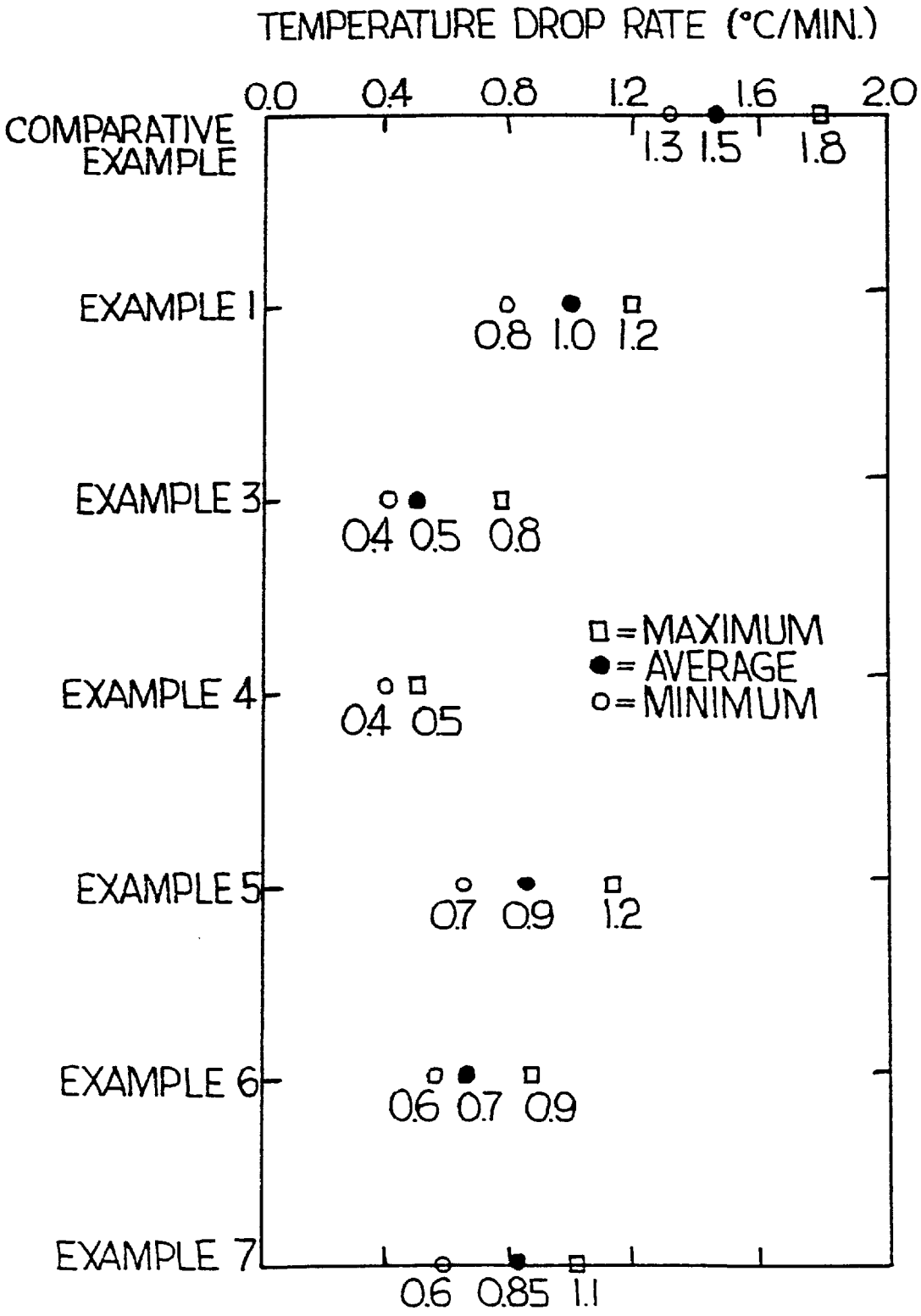
FIG. 12 is a graphical illustration showing molten steel temperature drop per minute during the decarburization for the present invention and a comparative example.

Further, at 0 minute and 17 minutes after the start of the decarburization, molten steel temperatures were measured. Then the temperature drop rates α were calculated based on Equation 5 below, and the results are illustrated in FIG. 12.

In Equation 5, T(17) and T(0) represent the temperatures of the molten steel at 17 minutes and 0 minute after the start of the decarburization respectively.

Figure 13:
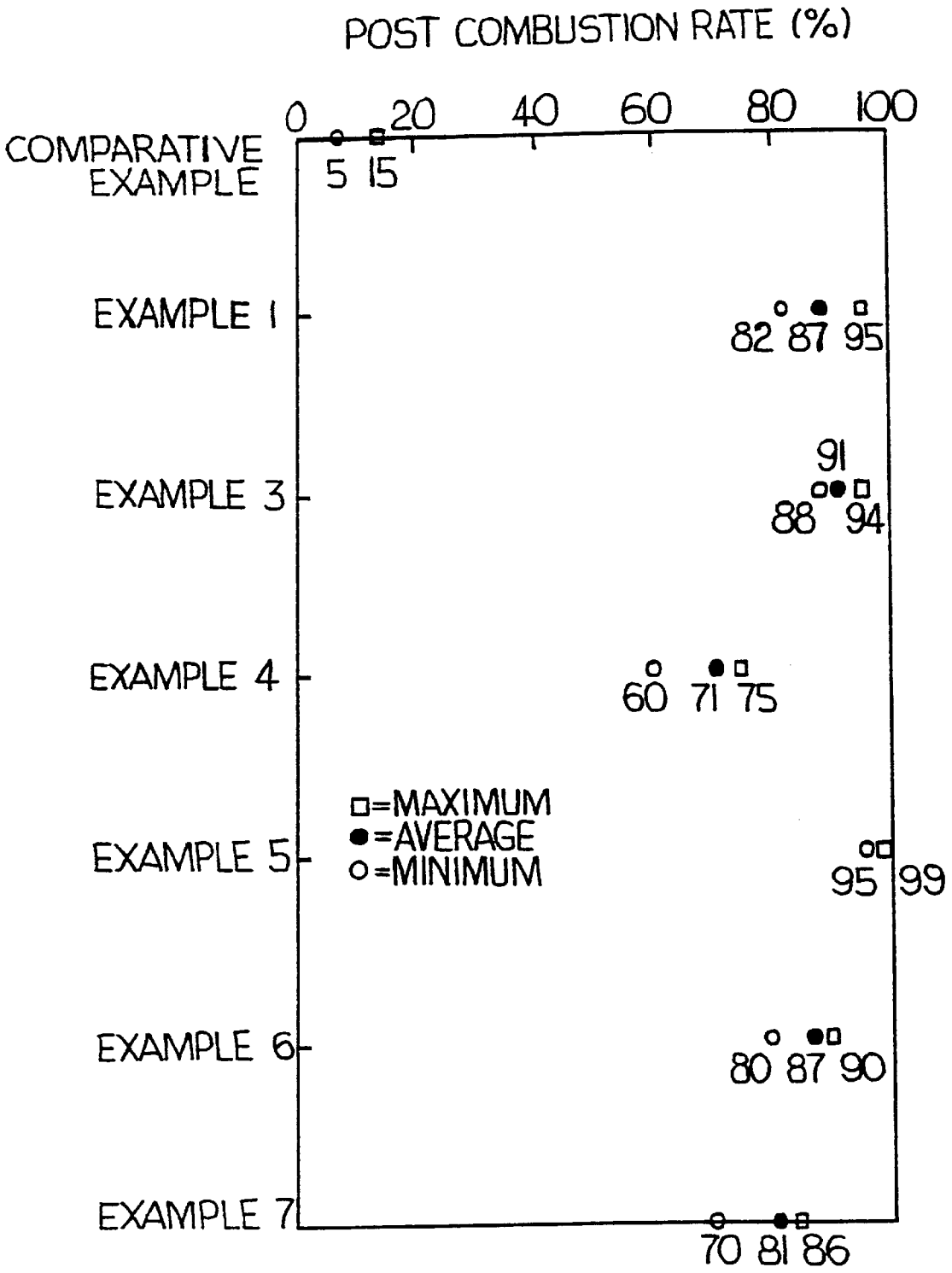
FIG. 13 is a graphical illustration showing a post combustion rate during the decarburization for the present invention and a comparative example.
Figure 14:
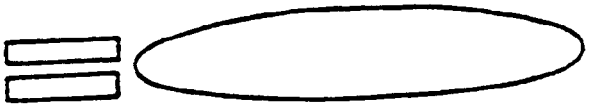
FIGS. 14(A) and 14(B) illustrate the stream shape of the injected gas for different shapes of the lance nozzles.
Figure 14:
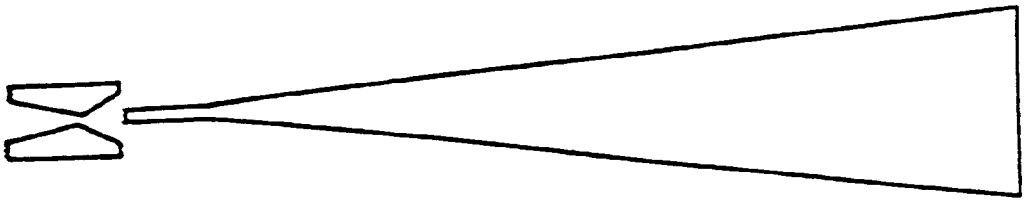

Further, the contents of carbon monoxide and carbon dioxide within the exhaust gas of the refining apparatus were measured by using an exhaust gas analyzing instrument. Then the secondary combustion rates were calculated based on Equation 6 below, and the results are illustrated in FIG. 13.

$$Kc = -\ln\frac{C(17)}{C(0)} \Big/ 17 \tag{4}$$

$$\alpha\left(C/\min = \frac{T(17) - T(0)}{17}\right. \tag{5}$$

$$\text{Post combustion rate} = \frac{(\%\,CO_2)}{(\%\,CO_2) + (\%\,CO)} \times 100 \tag{6}$$

As shown in FIG. 10, the refining process according to the present invention showed that the rate constant of decarburization Kc reached 0.14 to 0.17. The average value was 0.16, and this was significantly higher than that of the comparative example in which Kc was 0.10 to 0.13, and the average was 0.12. Further, as shown in FIG. 11, the present invention showed that the carbon content was 16 to 25 ppm, the average being 20 ppm, while the comparative example showed that it was 35 to 45 ppm, the average being 42 ppm. Therefore, it was apparent that the carbon content was significantly lower in the present invention compared with the comparative example.

As shown in FIG. 12, when the molten steel was refined according to the method of the present invention, the temperature drop rate $\alpha$ was −0.8 to −1.2, the average value being −1.0. Meanwhile in the comparative example, the temperature drop rate was −1.3 to −1.8, the average being −1.5. This witnesses that a large amount of heat was generated based on Equation 3.

As shown in FIG. 13, in the case where molten steel was refined according to the method of the present invention, the post combustion rate was 95–82%, the average being 87%, while in the comparative example, the post combustion rate was 5 to 15%, the average being 13%. Therefore, the post combustion rate of the present invention is significantly higher than that of the comparative example. This witnesses that the reaction of Equation 3 was very brisk, and it well corresponds to the graph of FIG. 12.

The refining process according to the present invention and the comparative example were carried out 30 times respectively, and the degree of the adherence of the skull was observed by the human eye. The result showed that the degree of the skull adherence with the present invention was much lower than that of the comparative example. Further, when the experiment was carried out over 100 times, no explosion due to the leaking of lance cooling fluid occurred during the injection of oxygen through the water cooled lances 150 and 160.

EXAMPLE 2

Experiments were carried out at conditions the same as those of Example 1, except that the oxygen injection conditions were different as described below. Then the rate constant of decarburization Kc was checked, and the results are illustrated in FIG. 10.

In this example, at the start of the refining of molten steel, oxygen gas was injected at a rate of 5 $Nm^3$/min through the inner tubes 12 of the lance nozzles 10 which were installed at the left and right sides of the immersion tubes 120 (FIG. 6) and on the wall of the vessel. After elapsing of 3 minutes, the injection was increased to 10 $Nm^3$/min, and after elapsing of 10 minutes, the injection was decreased to 5 $Nm^3$/min. Then upon completion of the decarburization, the injection was terminated.

This was for realizing the post combustion reaction of Equation 3.

Meanwhile, through the inner tubes 12 of the other two lance nozzles 10, oxygen gas was injected at a rate of 20 $Nm^3$/min from 3 minutes to 9 minutes after the start of the decarburization, and this was equivalent to 0.6 $Nm^3$ of oxygen per ton of molten steel. This was for promoting the decarburization reaction of Equation 2.

In this example, the method of the present invention showed a higher rate constant of decarburization Kc compared with that of the comparative example as shown in FIG. 10.

In the method of this example, the decarburization capability for the ultra low carbon steel was promoted, and at the same time, the post combustion reaction was maximized, so that carbon monoxide was prevented from being discharged into the atmospheric air.

In this example, the rate constant of decarburization Kc reached 0.16 to 0.17, but the carbon monoxide content within the exhaust gas of the refining apparatus was maintained at only 1.0 volume % or less.

EXAMPLE 3

This example was executed at conditions the same as those of Example 1, except the conditions of injection of oxygen gas and cooling gas.

That is, through the inner tubes 12 of the lance nozzles 10, oxygen gas was injected at a rate of 30 $Nm^3$/min with pressure of 9.5 $Kg/cm^2$. Through the outer tubes 14, a mixture consisting of argon and carbon monoxide at a ratio of 8:2 was injected at a rate of 4 $Nm^3$/min with pressure of 4.0 $Kg/cm^2$. At each charge of molten steel, oxygen gas was injected in an amount of 0.60 $Nm^3$ per ton of molten steel through the inner tubes 12, while a mixture consisting of argon and carbon monoxide was injected in an amount of 0.25 $Nm^3$ per ton of molten steel. The injection was carried out from the start of the decarburization to the completion of the decarburization.

The above described experiments were carried out 50 times. Then as in Example 1, the rate constant of decarburization Kc, the carbon content within molten steel at 17 minutes after the start of the decarburization, the temperature drop rate $\alpha$, and the post combustion rate were checked. The results are shown in FIGS. 10, 11, 12 and 13 respectively.

As illustrated in FIGS. 10–13, the method of the present invention showed a larger rate constant of decarburization Kc compared with that of the comparative example. Further, compared with the comparative example, the carbon content within molten steel was low, the molten steel temperature drop rate $\alpha$ was small, and the post combustion rate was high.

EXAMPLE 4

This example was executed at conditions the same as those of Example 3, except for the matters described below.

Oxygen gas was injected through the inner tubes 12, and industrial carbon monoxide was injected through the outer tubes 14 at a rate of 4 $Nm^3$/min with a pressure of 4.0 $Kg/cm^2$. In order to prevent corrosion of the lance nozzles 10 by carbon monoxide, the inner and outer tubes were made of ceramic material.

The above described experiments were carried out 10 times. Then as in Example 1, the rate constant of decarburization Kc, the carbon content within molten steel at 17 minutes after the start of the decarburization, the temperature drop rate α, and the post combustion rate were checked. The results are shown in FIGS. 10, 11, 12 and 13 respectively.

As illustrated in FIGS. 10–13, the method of the present invention showed a larger rate constant of decarburization Kc compared with the comparative example. Further, compared with the comparative example, the carbon content within molten steel was low, the molten steel temperature drop rate α was small, and the post combustion rate was high.

In this example, the reason why the molten steel temperature drop rate was further decreased was that carbon monoxide which was injected through the outer tubes participated in the post combustion reaction of Equation 3, thereby generating a large amount of heat. On the other hand, the reason why the secondary combustion rate was decreased in relative terms was that a part of carbon monoxide of the outer tube could not effect the secondary combustion reaction, but was discharged in the exhaust gas. This is the judgment of the present inventors.

EXAMPLE 5

This example was executed at conditions the same as those of Example 3, except that the inner tubes 12 were made to inject oxygen, and the outer tubes 14 were made to inject an industrial carbon dioxide gas at a rate of 45 $Nm^3$/min with a pressure of 4.0 $Kg/cm^2$.

Since the price of argon is relatively high, the outer tubes were made to inject carbon dioxide instead of argon so as to reduce the steel manufacturing cost.

The above described experiments were carried out 10 times. Then as in Example 1, the rate constant of decarburization Kc, the carbon content within the molten steel at 17 minutes after the start of the decarburization, the temperature drop rate α, and the post combustion rate were checked. The results are shown in FIGS. 10, 11, 12 and 13 respectively.

As illustrated in FIGS. 10–13, the method of the present invention showed a larger rate constant of decarburization Kc compared with that of the comparative example. Further, compared with the comparative example, the carbon content within molten steel was low, the molten steel temperature drop rate α was small, and the post combustion rate was high.

In this example, the post combustion rate was greatly increased, while the molten steel temperature drop rate α was increased in relative terms. The reason is judged to be that the post combustion rate was calculated based on Equation 6, and carbon dioxide from the outer tubes resulted in an increase of carbon dioxide in the exhaust gas. It is believed that carbon dioxide from the outer tubes actually inhibits the post combustion reaction, in view of the fact that the molten steel temperature drop rate was increased compared with Example 3.

EXAMPLE 6

This example was executed under conditions the same as those of Example 1, except that the inner tubes were made to inject mixture gas consisting of oxygen and carbon monoxide at a ratio of 8:2, and the outer tubes were made to inject argon.

The above described experiments were carried out 35 times. Then, as in Example 1, the rate constant of decarburization Kc, the carbon content within molten steel at 17 minutes after the start of the decarburization, the temperature drop rate α, and the post combustion rate were checked. The results are shown in FIGS. 10, 11, 12 and 13 respectively.

As illustrated in FIGS. 10–13, the method of the present invention showed a larger rate constant of decarburization Kc compared with that of the comparative example. Further, compared with the comparative example, the carbon content within molten steel was low, the molten steel temperature drop rate α was small, and the post combustion rate was high.

EXAMPLE 7

This example was executed under the same conditions as those of Example 1, except the matters to be described below.

In this example, the inner and outer tubes 12 and 14 of the lance nozzles 10 were made of a fine ceramic. During the decarburization, the inner tubes 12 were made to inject oxygen at a rate of 10 $Nm^3$/min, and 40 Kg of mill scale was injected simultaneously. The mill scale was a byproduct which was recovered from a continuous casting process and a hot rolling process of a steel mill. The steel component of the mill scale was sorted by means of a magnet, and was crushed to a particle size of 0.5 mm or less.

The outer tubes were made to inject carbon monoxide at a rate of 4 $Nm^3$/min with a pressure of 4.0 $Kg/cm^2$ from the start of the decarburization to its completion. The injected amount of oxygen was equivalent to 0.25 $Nm^3$ per ton of molten steel.

The above described experiments were carried out 10 times. Then as in Example 1, the rate constant of decarburization Kc, the carbon content within molten steel at 17 minutes after the start of the decarburization, the temperature drop rate α, and the post combustion rate were checked. The results are shown in FIGS. 10, 11, 12 and 13 respectively.

As illustrated in FIGS. 10–13, the method of the present invention showed a larger rate constant of decarburization Kc compared with that of the comparative example. Further, compared with the comparative example, the carbon content within molten steel was low, the molten steel temperature drop rate α was small, and the post combustion rate was high.

In this example, the carbon content in the finally decarburized molten steel was further decreased. The reason is that the injected mill scale deeply intrudes into molten steel so as to be decomposed into steel and soluble oxygen. Thus, oxygen was supplied to molten steel, and at the same time, the sites for decarburization were furnished.

As seen in the above described examples, if molten steel is refined according to the present invention, ultra low carbon steel with a carbon content of 20 ppm or less can be manufactured in a stable manner.

According to the present invention as described above, the decarburization time period for manufacturing ultra low carbon steel can be significantly reduced, the molten steel temperature drop rate can be effectively reduced during the decarburization, and the amount of skull accumulating on the inner wall of the vessel can be decreased. Further, when the oxygen gas is injected through water cooled lance nozzles, the danger of lance cooling water leakage can be excluded.

What is claimed is:

1. An apparatus for refining molten steel for manufacturing ultra low carbon steel comprising: an RH vacuum-degassing device consisting of a vessel and a snorkel composed of an up-leg and a down-leg, and the apparatus further comprising:

a plurality of gas injection lance nozzles each consisting of an inner tube and an outer tube and installed above a molten steel level on a side wall of said vacuum vessel of said vacuum-degassing device at a height 1.9 to 3.0 times the radius of said vacuum vessel so as to inject gas toward the molten steel within said vacuum vessel;

said inner tube including a neck portion forming a jet stream of a super-sonic velocity;

said outer tube injecting a cooling gas for cooling said inner tube, wherein each of said lance nozzles has a leading end portion, and each of said lance nozzles is installed such that said leading end portion is disposed evenly with an inner wall of said vessel; and said neck portion has a straight cylindrical portion, and the inner circumferential surface of said inner tube is expanded with a constant angle θ3 of 3° to 10° toward said leading end portion from said neck portion and an angle θ1 between said gas injection lance nozzle and said side wall of said vessel is 20° to 35°.

2. The apparatus as claimed in claim 1, wherein said straight cylindrical portion has a length of 4 to 6 mm.

3. The apparatus as claimed in claim 1 having two or four lance nozzles.

4. The apparatus as claimed in claim 1, wherein an inside diameter of said throat and an inside diameter of said leading end portion have a size ratio of 1.1 to 3.0.

5. The apparatus as claimed in claim 1 having two lance nozzles, each disposed on a diametric line L1 passing through a center of said vessel forming an angle θ2 of 60° to 120° relative to a line L2 connecting said up-leg and said down-leg of the snorkel.

6. The apparatus as claimed in claim 1 having four lance nozzles disposed in opposed pairs on diametrically extending lines L3 and L4 which connect two opposite pairs of said lance nozzles and passing through a center C of said vessel wherein said lines L3 and L4 intersect each other at right angles.

7. The apparatus as claimed in claim 1, wherein a gap of 2 to 4 mm is formed between an outer circumference of said inner tube and an inner circumference of said outer tube.

* * * * *

UNITED STATES PATENT AND TRADEMARK OFFICE

CERTIFICATE OF CORRECTION

PATENT NO. : 6,156,263
DATED : December 5, 2000
INVENTOR(S) : Sang Bok An et al.

It is certified that error appears in the above-identified patent and that said Letters Patent is hereby corrected as shown below:

Title page,
Item [56] References Cited, FOREIGN PATENT DOCUMENTS,
Reference 5, "6400217" should read -- 64000217 --.

Column 2,
Line 42, "ajet" should read -- a jet --.

Column 3,
Line 11, "ajet" should read -- a jet --.

Column 4,
Line 32, "inner wall 10a" should read -- inner wall 110a --.

Column 9,
Line 55, "forms ajet" should read -- forms a jet --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*